United States Patent [19]

Rayburn

[11] Patent Number: 4,916,827

[45] Date of Patent: Apr. 17, 1990

[54] GUIDE DEVICE FOR MAKING ENTRIES IN TRUCKER'S LOG BOOK

[75] Inventor: William H. Rayburn, Tacoma, Wash.

[73] Assignee: Premium Technologies, Inc., Tacoma, Wash.

[21] Appl. No.: 356,009

[22] Filed: May 23, 1989

[51] Int. Cl.[4] ..... E07C 1/18

[52] U.S. Cl. ..... 33/563; 33/566

[58] Field of Search ..... 33/562, 563, 564, 565, 33/566, 1 B, 1 G, 1 K, 1 AA, 430, 443, 474; 116/235

[56] References Cited

U.S. PATENT DOCUMENTS

| | | | |
|---|---|---|---|
| 2,226,906 | 10/1939 | Henderson et al. | 33/443 |
| 2,230,927 | 2/1941 | Bowman et al. | 33/443 |
| 2,251,845 | 8/1941 | Large | 33/443 |
| 3,144,716 | 8/1964 | Cich | 33/486 |
| 3,974,568 | 8/1976 | Linderman | 33/486 |
| 4,338,512 | 7/1982 | Ludwig | 377/20 |

*Primary Examiner*—William A. Cuchlinski, Jr.
*Assistant Examiner*—Alvin Wirthlin
*Attorney, Agent, or Firm*—Bruce A. Kaser

[57] ABSTRACT

A flat, ruler-like guide is shaped to be laid over the tables and scales set forth in a trucker's log book. The guide has cut-out portions which outline only those entries in the log book which the trucker needs for making certain calculations. Printed on the face of the guide are equations which the trucker follows in making these calculations.

8 Claims, 4 Drawing Sheets

GUIDE DEVICE FOR MAKING ENTRIES IN TRUCKER'S LOG BOOK

DESCRIPTION

1. Technical Field

This invention relates to a ruler-like device which a trucker can use to assist him in making certain calculations that are entered in a log book.

2. Background Information

The maximum number of hours which a commercial trucker may drive during a given period is regulated by the government. Every trucker who travels more than 100 miles from his home terminal is required by federal regulations to keep a log book as evidence that the trucker has not exceeded this number. Log books are kept on a monthly basis, meaning a separate log book is typically completed for each month the trucker operates.

The format of log books is uniform throughout the trucking industry. Every log book has a plurality of daily log sheets which summarizes the trucker's on-duty and off-duty hours during a given 24-hour time period. These sheets are filed at the trucker's home terminal. Each log book also has a monthly summary sheet which provides a day-by-day diary of the trucker's daily hours, the total hours the trucker has been on duty during a certain period, and the total hours available to the trucker so that he does not exceed the maximum.

Under law, truckers may generally operate in accordance with either one of two schedules. One is an operating period of 70 on-duty hours in 8 consecutive days. The other is 60 on-duty hours during a 7-day period. On-duty hours include both actual driving hours and hours which the trucker is on-duty but not driving. A log book's monthly summary sheet will have two separate tables, one for each of these schedules.

The trucker normally makes daily entries on the monthly summary sheet which includes making certain mathematical calculations involving the trucker's on-duty hours during the trucker's particular operating period, i.e. 70 hours in 8 days or 60 hours in 7 days. Part of this includes calculating the total hours which the trucker may work on the next day so that he keeps tabs on the permitted maximum. However, since these tables include numerous rows and columns, and the calculations which the trucker makes involves looking up entries from previous days, it is easy for a trucker to misread an entry and consequently make an erroneous calculation. The result is that the trucker may inadvertently stay on duty a greater period of time than that which is permitted by law.

The present invention provides a simple, convenient aid for making log book calculations and helps to eliminate these kinds of errors.

SUMMARY OF THE INVENTION

The invention is a thin, flat guide member which is shaped to be laid flatly across the columns of a monthly summary sheet's tables, and across the scales of a daily log sheet. The guide member has first and second window sets, with each set including a first and second cut-out portion. The first cut-out portion will display a row across the columns of each table on the summary sheet when the guide member is positioned in a certain manner. The second cut-out portion displays the hours worked on a certain day which precedes the day which is to be entered on the summary sheet. The cut-out portions emphasize only those entries which the trucker needs to make calculations for a given day. Reference symbols are positioned adjacent each entry and a communication consisting of a plurality of equations is printed on the face of the guide member. The trucker simply enters the hours worked on the day of the entry, and follows the equations in sequence in order to fill out the remaining entries for that day.

The guide-member preferably has straight top and bottom edges which are interconnected on the right-hand side by an angled edge. The angled edge is used by the trucker to make certain notations on the bottom of the daily log sheets. Also printed on the face of the guide member, adjacent its bottom edge, is an hourly scale which the trucker may use to help calculate on and off-duty hours which are entered on the daily log sheet.

The invention will become better understood and more fully explained upon consideration of the following description when taken in conjunction with the drawings.

BRIEF DESCRIPTION OF THE DRAWINGS

In the drawings, like reference numerals and letters refer to like parts throughout the various views, and wherein.

BEST MODE FOR CARRYING OUT THE INVENTION

Figure 1:
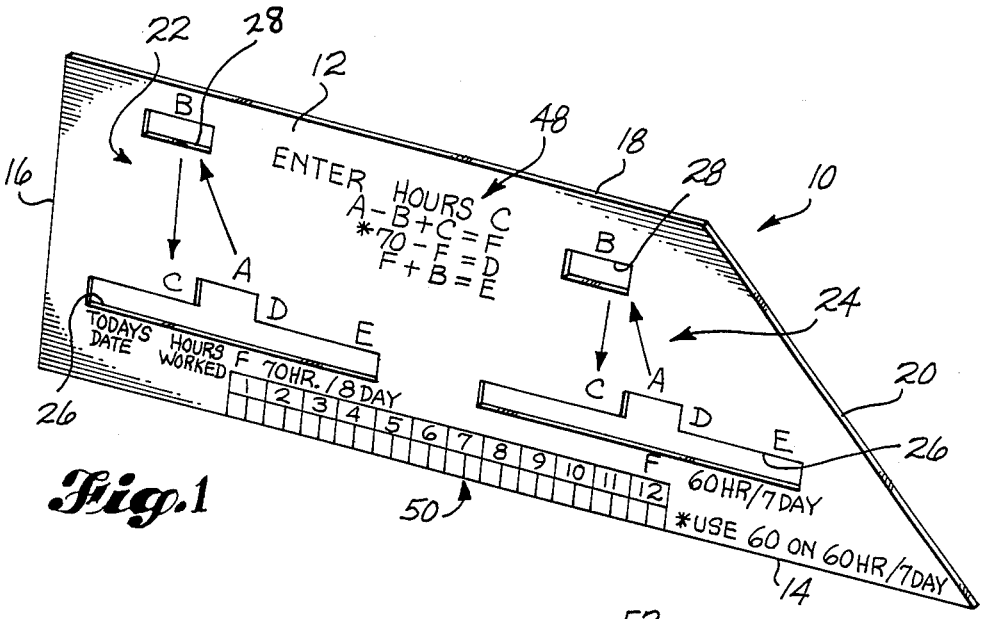
FIG. 1 is a pictorial view of a guide member constructed in accordance with a preferred embodiment of the invention.

Referring now to the drawings, and first to FIG. 1, therein is shown at 10 a preferred embodiment of a guide device or member (hereafter "guide") constructed in accordance with the invention. The guide 10 is made of a thin, normally flat sheet 12 of a suitable material such as plastic. It is approximately 6 to 6½ inches long at its lower edge 14, and 2 inches high along its vertical edge 16. Its upper edge 18 is approximately 4 to 4½ inches long. Upper and lower edges 18, 14, which are both straight, are interconnected by an angled right-hand edge 20. The use and function of this edge 20 will be further explained later.

The guide 10 has first and second window sets which are indicated generally by arrows 22, 24. Each window set 22, 24 has first and second cut-out portions 26, 28 through the thickness of the guide 10. The function of these portions 26, 28 will now be explained by referring to FIGS. 3 and 4.

Figure 3:
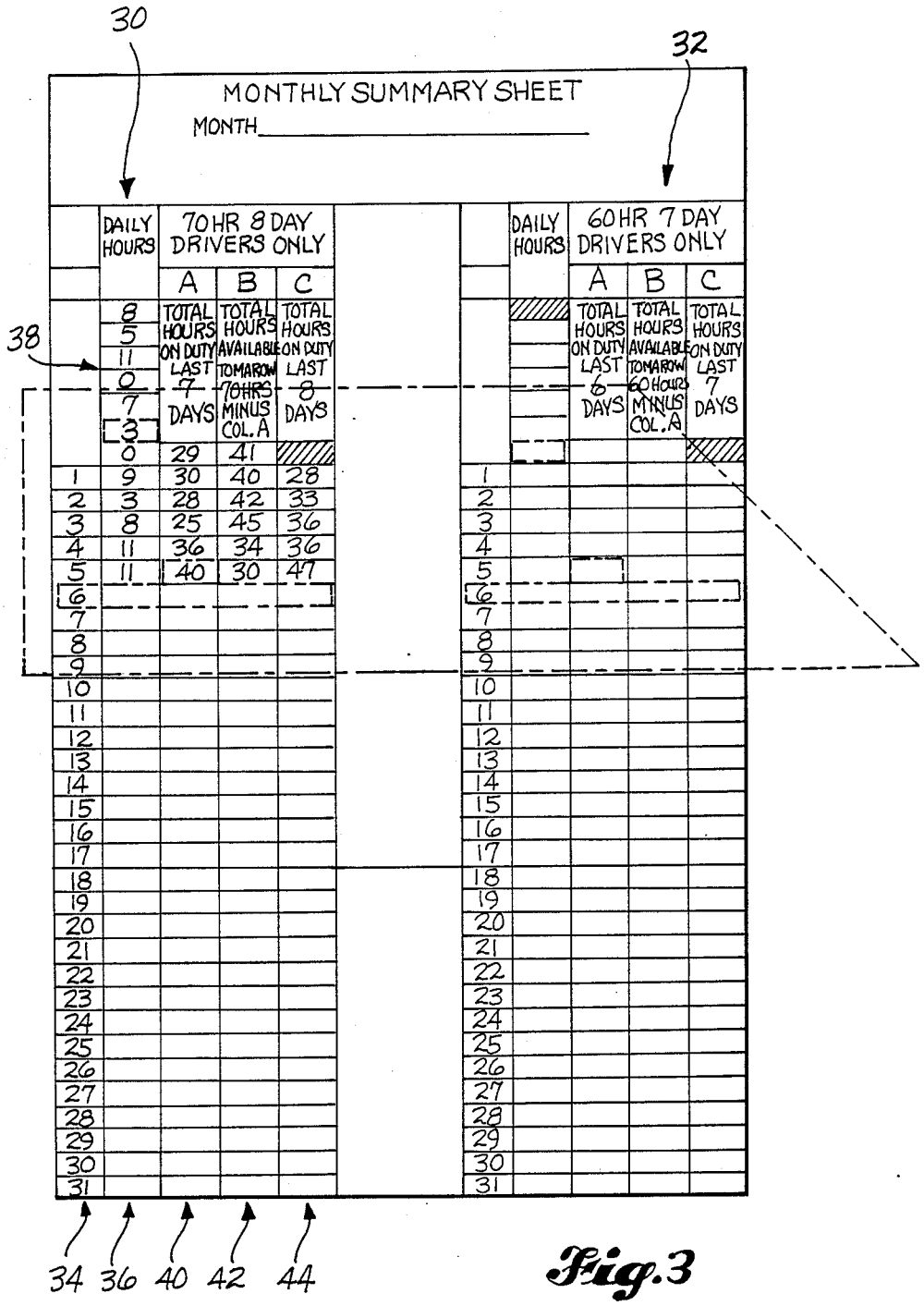
FIG. 3 is a drawing of a monthly summary sheet taken from a trucker's log book, and schematically indicates in dashed lines the guide member of FIG. 1 laid flatly across the sheet.

FIG. 3 is a drawing of a monthly summary sheet and is typical to any trucker's log book. The sheet has two tables indicated generally by arrows 30, 32. Each table has five side-by-side columns organized into rows for listing the daily entries for each day of the month which is to be summarized. The first !column, indicated generally by arrow 34, lists the days of the month. The second 36 lists the trucker's daily entries of the number of on-duty hours worked for each day of the month. At the top of the second column, indicated at 38, is a listing of the daily on-duty hours for the last calculation period of the preceding month. In other words, and as was explained previously, a trucker may operate under a 70-hour/8-day schedule or a 60-hour/7-day schedule. Table 30 is for the former and table 32 is for the latter. The trucker's total hours during the 8 or 7-day period is based on a calculation period which is one day less than the operating period. That is, with respect to table 30 (70-hour/8-day) the calculation period is seven days. The daily entries at the top of the second column 36 (as indicated by arrow 38) reflect the last seven days of the preceding month. In table 32 only the last six days of the preceding month are set forth at 38 in the second column 36, which reflects a shorter calculation period for the correspondingly shorter operating period. A trucker or other person familiar with log books would also be familiar with these calculations.

The third column 40 of the tables lists the trucker's total hours on duty during the last calculation period (seven days in the case of table 30, and six days in the case of table 32). The fourth column 42 lists the total hours which are available to the trucker on the day following the day of entry. In other words, the fourth column tells the trucker how many hours he may work without exceeding the maximum allowable. The last or fifth column 44 lists the trucker's total hours on duty during his selected operating period (eight days for table 30 or seven days for table 32).

FIG. 3 is an example of a trucker operating under the 70-hour/8-day schedule who has entered the first five days of a current month, and is about to make entries for the sixth day. The guide 10 is positioned so that the second cut-out portion 26 displays not only the day of entry (day 6) but also the corresponding column entries of the other columns across the row defined by day 6. A central portion of cut-out portion 26, which is indicated at 46 in FIG. 4, displays that entry in the third column which immediately precedes the daily entry of concern.

Figure 4:
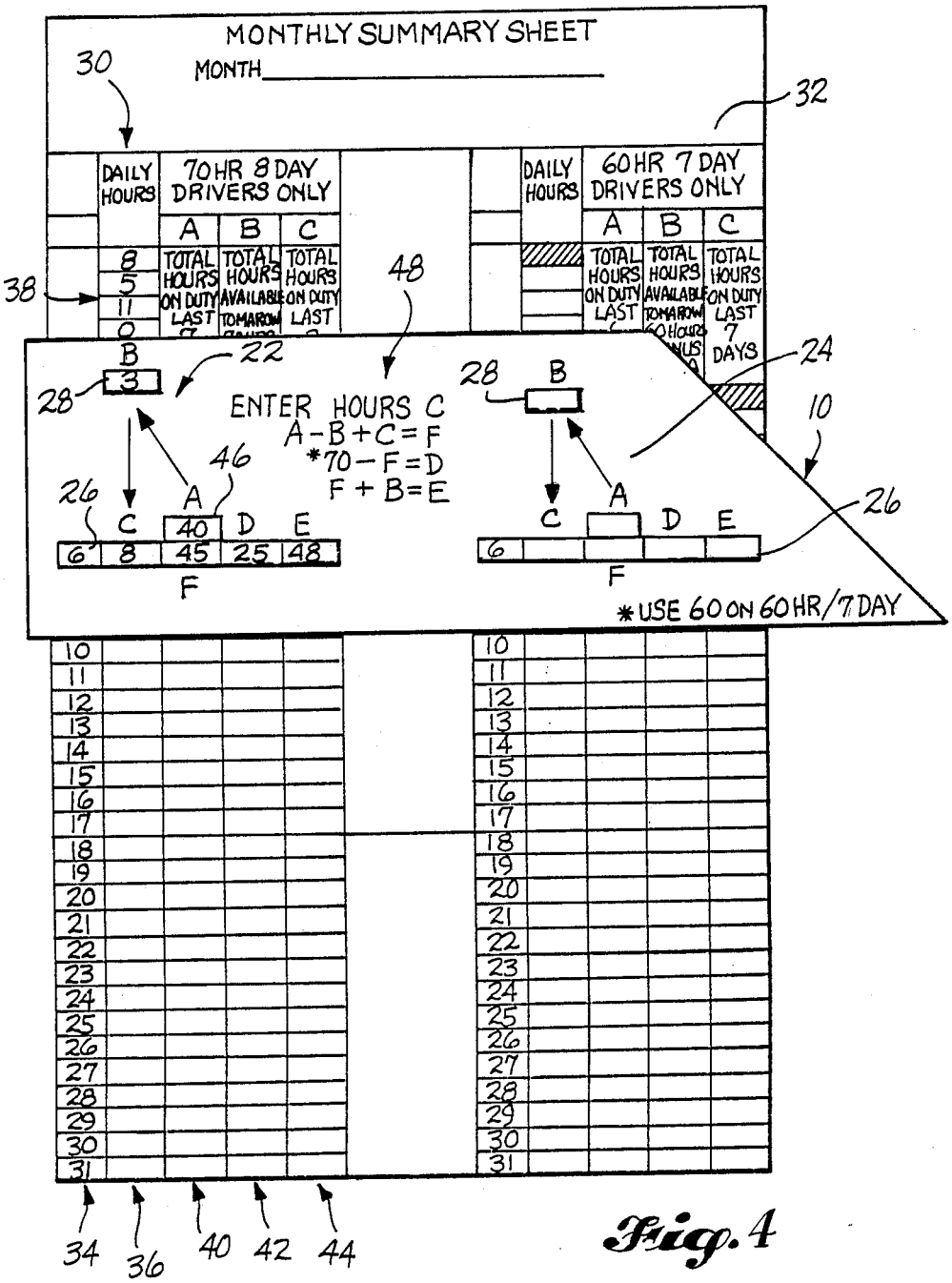
FIG. 4 is a view like FIG. 3 but illustrates how the guide member of FIG. 1 is used to make entries on the monthly summary sheet.

As is more clearly shown in FIG. 4, the second cut-out portion 28 displays the first day of the calculation period for the daily entry. In other words, in table 30 the second cut-out portion 28 displays the first day of the calculation period which immediately precedes the daily entry, and to be more exact, it displays the eighth day including the daily entry (the seventh day preceding the entry).

Letters A through F on the guide 10 indicate the various tabular entries the trucker must use. When the guide 10 is first placed on the sheet all of the entries will be blank with the exception of (a) the daily entry in first column 34, (b) entry B displayed in the second cut-out portion 28, and (c) entry A displayed at 46. The trucker then fills in at C the hours worked for that day (8 hours) in accordance with the first line of the instructions shown on the face of the guide at 48. He then follows the equations on the guide in sequential order.

By way of illustration, after filling out the daily hours (8 hours) at entry C, he then goes to the next equation and calculates F (40 minus 3 plus 8 equals 45). He then writes this in the third column 40 (at entry F). This is followed by calculating entry D (70 minus 45 equals 25) which is suitably entered. The final calculation involves making the entry at E in the last column 44 (45 plus 3 equals 48).

The sequence of entries and calculations is identical if the trucker is using the second table 32. However, the trucker substitutes "60" for "70" in the calculation of entry D as is indicated by the asterisk next to the equation.

Thus, the guide 10 outlines only those tabular entries which the trucker needs in order to make the needed calculations. It eliminates the probability that he will misread previously entered information.

Figure 5:
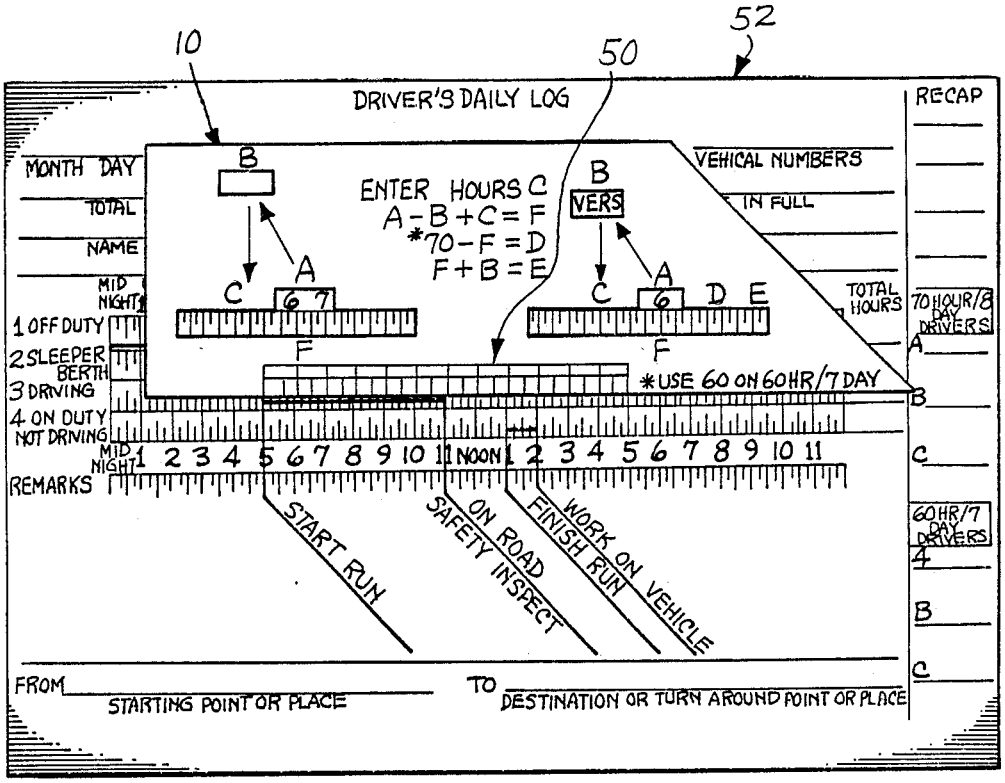
FIG. 5 is a view like FIG. 2, but shows how a scale on the guide member is used to calculate hours on the daily log sheet.

Referring back to FIG. 1, printed adjacent the lower edge 14 of the guide member is an hourly scale 50. This scale 50 is used by the trucker in reading the hours which he lists on his daily log sheet 52 (see FIGS. 2 and 5). As would be familiar to a person skilled in the art, each log sheet has five scales. The first is for indicating off-duty hours, the second is for sleeper/berth hours, the third is for driving hours, the fourth is for on-duty but not driving hours, and the last or fifth is for entering remarks. All of the scales are gauged equally over a 24-hour period.

Figure 2:
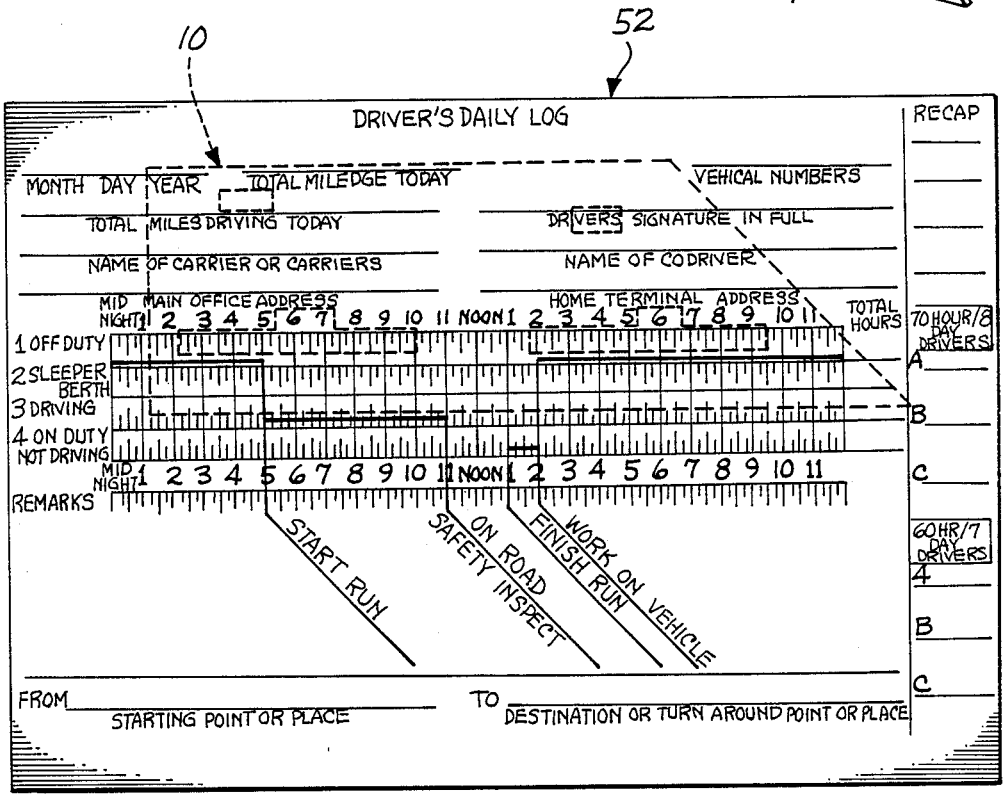
FIG. 2 is a drawing of a driver's daily log sheet taken from a trucker's log book, and shows in dashed lines the guide member of FIG. 1 laid across the log sheet.

As is indicated in FIG. 2, the trucker simply draws a line through the appropriate scale to indicate the number of hours on or off duty, in the sleeper/berth, etc. After the daily sheet is filled out, the trucker calculates the total hours on and off duty and enters them on the right-hand side of the sheet 52. The on-duty hours are subsequently entered on the monthly summary sheet of FIGS. 3 and 4. The gauge of scale 50 on guide 10 is equal to the gauge of the scales on the daily log sheet. This allows the trucker to run the guide's scale 50 along the hours entered on the sheet's scales and makes it easy to add them up.

The guide's right-hand angled edge 20 is used to make diagonal lines along the base of the log sheet for any required remarks during each day. For example, "start run," "on road safety inspection," etc.

The preceding description provides the current best known way to carry out the invention. It is to be understood that certain changes could be made to the guide disclosed above without departing from the spirit and scope of the inventive subject matter. Therefore, nothing stated above should be regarded in the limiting sense. Rather, the scope of any patent coverage available is to be limited and defined by the patent claims which follow, the interpretation of which is to be made in accordance with the established doctrines of patent claim interpretation.

What is claimed is:

1. For use in connection with a trucker's log book, said log book having a monthly summary sheet with daily entries indicating the total number of on-duty hours which a trucker has worked during a given regulated operating period consisting of a certain number of days, such total not to exceed a regulated number of hours during such operating period, and each daily entry also indicating the available on-duty hours the trucker may work on the day following each entry, so that said trucker will not work more than said regulated number of hours during said given operating period, wherein the daily entries are determined by using a calculation period which is one day less than the length of said operating period, and with said monthly summary sheet being further characterized in that it includes at least one table of five side-by-side columns organized into rows for listing the daily entries for each day of the particular month to be summarized, and wherein the first column lists each day of said particular month to be summarized; and the second column lists the trucker's daily entries of the number of on-duty hours for each day of said particular month, said second column also listing the daily on-duty hours for each day of the last calculation period of the preceding month, the last day of such period being the last day of the preceding month; and the third column lists the trucker's daily entry of the total on-duty hours during any given calculation period preceding and including the day of entry, the day of entry being the last day of the calculation period, said third column also listing the total on-duty hours during the last calculation period of the preceding month as set forth in the second column; and the fourth column lists the trucker's daily entry of the total available hours which e trucker may work on the day following each daily entry, said fourth column also listing the total hours available for the first day of said month; and the fifth column lists the trucker's daily entries of the total hours on-duty during the operating period immediately preceding and including the day of entry, the day of entry being the last day of the operating period;

a device for assisting the trucker in calculating and entering the daily entries on said table, comprising:

a guide member shaped to be laid flatly across the columns of said table, said guide member having at least one window set including a first and second cut-out portion, said cut-out portions being shaped in a manner so that when said guide member is positioned across said columns in a certain manner, said first cut-out portion displays one day of said particular month to be summarized as listed in the first column, and the corresponding entry locations for such day on the remaining columns, and said first cut-out portion further displays the daily entry for the day preceding said one day as listed in said table's third column, and said second cut-out portion displays a certain prior daily entry listed in said table's second column, said prior entry corresponding to the first day of the calculation period for said trucker's regulated operating period, and a communication displayed on the guide member which instructs the trucker as to how to calculate the daily entries in the third, fourth and fifth columns for said one day.

2. The invention as set forth in claim 1, wherein said summary sheet includes two tables parallelly arranged with respect to each other, one table summarizing a regulated trucker operating period of 8 days and 70 regulated on-duty hours to be worked in such period, and the other table summarizing a regulated trucker operating period of 7 days and 60 regulated on-duty hours to be worked in such period, and wherein said guide member is shaped to be laid flatly across both tables at the same time, and when in such position, said window set is arranged for use with one of said tables to permit a trucker to calculate the daily entries for said one table in accordance with the regulated operating period of such table, and said guide member has a second window set, spaced from said first window set, and arranged for permitting the trucker to calculate the daily entries for said other table in accordance with the regulated operating period of said other table.

3. The invention as set forth in claim 1, wherein said guide member includes a straight top edge, a straight bottom edge, and a straight angled edge interconnecting said top and bottom edges.

4. The invention as set forth in claim 1, wherein said trucker's log book has a multiplicity of daily log sheets for recordation of the trucker's on-duty and off-duty hours during a given 24-hour time period, said on-duty hours to be entered into the second column of said monthly summary sheet's table, each daily log sheet including five equally gauged 24-hour scales, the first scale for recording the trucker's off-duty hours during said 24-hour period, the second scale for recording the trucker's sleep berth hours during said 24-hour period, the third scale for recording the trucker's driving hours during said 24-hour period, the fourth scale for recording the trucker's on-duty but not driving hours during said 24-hour period, and the fifth scale for assisting the trucker in recording remarks during said 24-hour period corresponding to certain events which may occur during such period, and wherein said guide member has a lower edge with a scale displayed adjacent said edge, said scale having the same gauge as said five 24-hour scales, to facilitate the trucker's use of said 24-hour scales.

5. The invention as set forth in claim 2, wherein at least a portion of said communication which is displayed on the guide member is positioned between said first and second window sets.

6. The invention as set forth in claim 2, wherein said guide member includes a straight top edge, a straight bottom edge and a straight angled edge interconnecting said top and bottom edges.

7. The invention as set forth in claim 6, wherein said trucker's log book has a multiplicity of daily log sheets for recordation of the trucker's on-duty and off-duty hours during a given 24-hour time period, said on-duty hours to be entered into the second column of one of said monthly summary sheet tables, each daily log sheet including five equally-gauged 24-hour scales, the first scale for recording the trucker's off-duty hours during said 24-hour period, the second scale for recording the trucker's sleep berth hours during said 24-hour period, the third scale for recording the trucker's driving hours during said 24-hour period, the fourth scale for recording the trucker's on-duty but not driving hours during said 24-hour period, and the fifth scale for assisting the trucker in recording remarks during said 24-hour period corresponding to certain events which may occur during such period, and wherein said guide member has a scale displayed adjacent said guide member's bottom edge, said scale having the same gauge as said five 24-hour scales, to facilitate the trucker's use of said 24-hour scales.

8. The invention as set forth in claim 1, wherein said first cut-out portion comprises a rectangular cut-out area through said guide member having a length substantially equal to the width of said five side-by-side columns of said table, the height of said rectangular cut-out area being substantially equal to the height of each row across said table except in the central portion of said cut-out area, and wherein in said central portion the height of said cut-out area is substantially equal to the height of two adjacent rows of said table, and said second cut-out portion comprises a second rectangular cut-out area through said guide member.

* * * * *